US007059263B1

(12) United States Patent
Zimmerman

(10) Patent No.: US 7,059,263 B1
(45) Date of Patent: Jun. 13, 2006

(54) GRAVITY INSTALLED ANCHOR

(75) Inventor: Evan H. Zimmerman, Houston, TX (US)

(73) Assignee: Delmar Systems, Inc., Broussard, LA (US)

( * ) Notice: Subject to any disclaimer, the term of this patent is extended or adjusted under 35 U.S.C. 154(b) by 0 days.

(21) Appl. No.: 10/993,968

(22) Filed: Nov. 19, 2004

Related U.S. Application Data

(60) Provisional application No. 60/627,246, filed on Nov. 12, 2004.

(51) Int. Cl.
*B63B 21/34* (2006.01)

(52) U.S. Cl. ..... 114/301

(58) Field of Classification Search ..... 114/293, 114/294, 295, 301–304; 52/155, 156, 162–164
See application file for complete search history.

(56) References Cited

U.S. PATENT DOCUMENTS 631,168 A * 8/1899 Lanston ..... 52/155
2,490,465 A * 12/1949 Ogburn ..... 52/164
3,279,136 A * 10/1966 Smith ..... 52/164

* cited by examiner

*Primary Examiner*—Ed Swinehart
(74) *Attorney, Agent, or Firm*—Jesse D. Lambert

(57) ABSTRACT

An anchor for mooring of structures to a water bottom, comprising an elongated central body having a longitudinal axis through its center. The central body comprises a plurality of channel members radiating outward from the center, each with a channel therein. A plurality of nose and tail plates are disposed within the channels, and hingedly connected to the central body, so that the plates can be swung in or out from the central body, and thereafter fixed in place (for example, by pins inserted through mating holes in the channel members and plates). A means for attaching a mooring line to the anchor, for example a load ring encircling the central body and rotatable completely around the circumference of the central body, has an arm hingedly attached thereto. The arm can be rotated to a desired angle with respect to the longitudinal axis of the central body, and fixed at a set angle or within a range of angles to the longitudinal axis.

17 Claims, 7 Drawing Sheets

GRAVITY INSTALLED ANCHOR

CROSS REFERENCE TO RELATED APPLICATIONS

This regular patent application claims priority to provisional patent application titled "Gravity Installed Anchor," inventor Evan H. Zimmerman, filed Nov. 12, 2004, provisional patent application serial No. 60/627,246.

BACKGROUND

1. Field of the Invention

This invention relates to apparatus used in the mooring of structures to the soils underlying bodies of water, referred to as waterbottoms. More specifically, this invention relates to a type of anchor particularly, although not exclusively, suitable for so-called "gravity installation," where the anchor is released at a desired height above a water bottom and allowed to fall to and penetrate into the waterbottom.

2. Description of Related Art

Different types of anchors, especially suited for the mooring of floating structures, have long been in use. Some anchors rely on their weight for holding capacity. Others have flukes which tend to drive the anchor into the waterbottom when a tension is applied to a mooring line. Still others embed into the waterbottom by a suction process.

Another type of anchor which is employed for mooring purposes is the so-called gravity installed anchor, which is lowered from the surface of a body of water to a desired height above a waterbottom, and then released to fall to and penetrate into the waterbottom. The inertia of the anchor carries it into the soils comprising the waterbottom. Thereafter, a tension can be applied to a mooring line connected to the anchor. Examples of such anchors known in the art include U.S. Pat. No. 6,106,199 to Medeiro, Jr. et al (Aug. 22, 2000) and U.S. Pat. No. 6,257,166 to Lieng (Jul. 10, 2001). The anchors disclosed therein comprise a generally circular in cross section central body, with a plurality of fins or blades connected to the central body. Such anchors lack the advantages presented by the present invention. One disadvantage of the prior art gravity-installed anchor designs is that a significant amount of penetration into the soil is required for adequate holding capacity. Typically, prior art designs require penetration depths (into the soils) well in excess of the longitudinal length of the anchor. The anchor of the present invention generally only requires penetration just beyond its full length, typically half that required by other gravity installed anchors.

In addition, mooring line attachment points to such anchor designs are limited to top (that is, the uppermost end) or fixed side attachments. Top attachments do not require any particular alignment with the mooring line direction since the pull can be from any direction; however, the top attachment greatly reduces holding capacity. Side attachments yield greater holding capacity, however current designs require accurate attachment point orientation (that is, the attachment point must be aligned with the direction of mooring line pull). Angular alignment of the side attachment point with the mooring line pull can be difficult to achieve in field applications. The present invention preferably comprises a mooring line attachment which can rotate completely around the body of the anchor, and further comprises a hinged arm, eliminating problems related to installation orientation. Further, the arm reduces the likelihood of the mooring line being caught on the anchor plates. Yet another advantage of the present invention is that a single anchor can be adjusted to vary the exposed nose and tail plate areas, thereby rendering the anchor suitable for various applications, soil types, or soil strength gradients.

BRIEF SUMMARY OF THE PRESENT INVENTION

The anchor of the present invention, in a presently preferred embodiment, comprises an elongated central body having a longitudinal axis through its center. The central body comprises a plurality of channel members radiating outward from the center, each with a channel therein. A plurality of nose and tail plates are disposed within the channels, and hingedly connected to the central body, so that the plates can be rotated in or out from the central body, and thereafter fixed in place (for example, by pins inserted through mating holes in the channel members and plates). A means for attaching a mooring line to the anchor, for example a load ring assembly comprising a load ring encircling the central body and rotatable completely around the circumference of the central body, has a bracket thereon and an arm hingedly attached thereto. The arm can be rotated to a desired angle with respect to the longitudinal axis of the central body, and fixed in a set angle or within a range of angles to the longitudinal axis.

DETAILED DESCRIPTION OF SOME OF THE PRESENTLY PREFERRED EMBODIMENTS

Those having skill in the relevant art will recognize various changes which may be made to the embodiments disclosed herein, without departing from the nature and spirit of the invention. For illustrative purposes, some of the presently preferred embodiments of the invention will now be described, with reference to the drawings.

Figure 1:
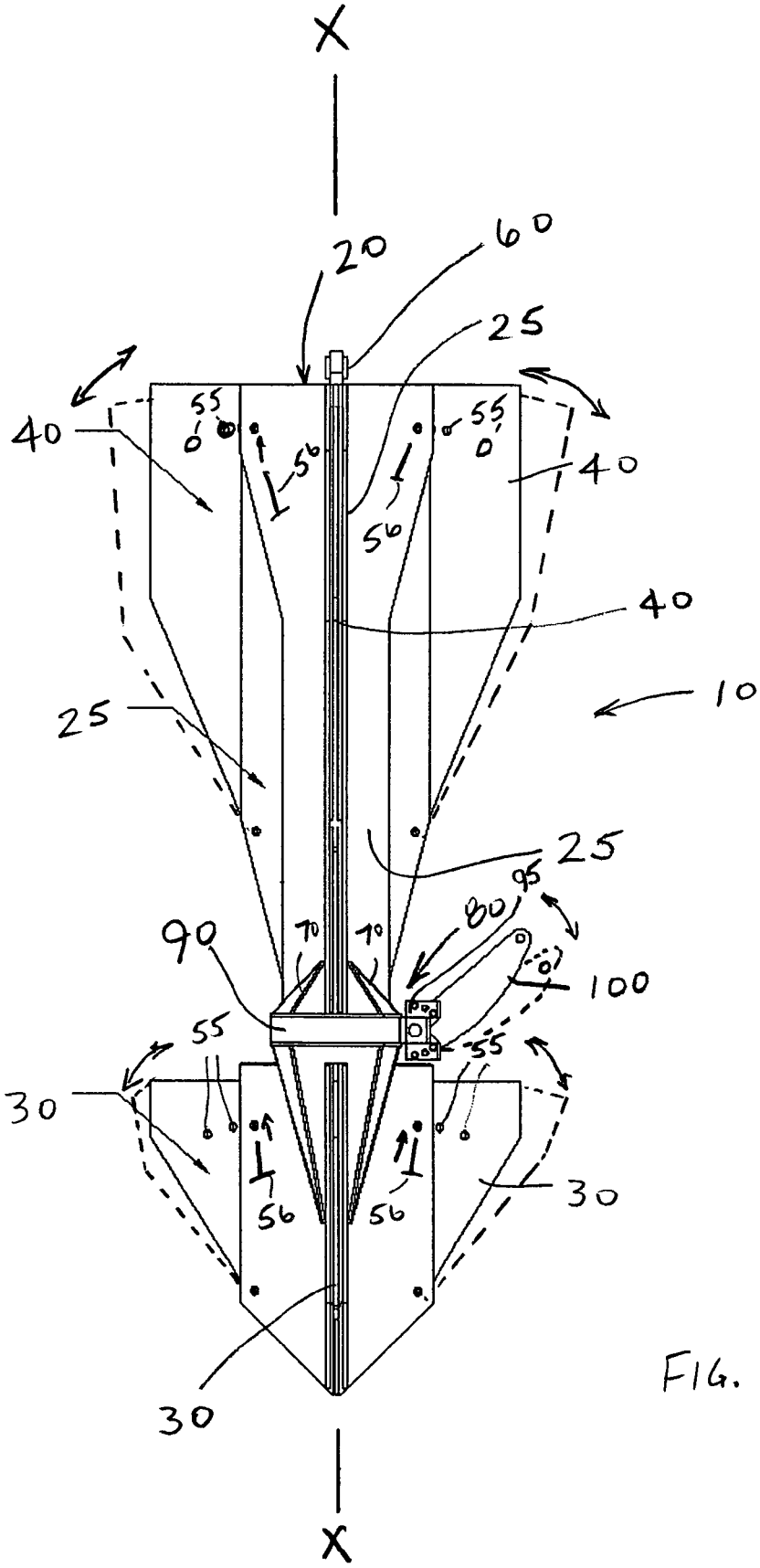
FIG. 1 is a side view of the anchor.
Figure 2:
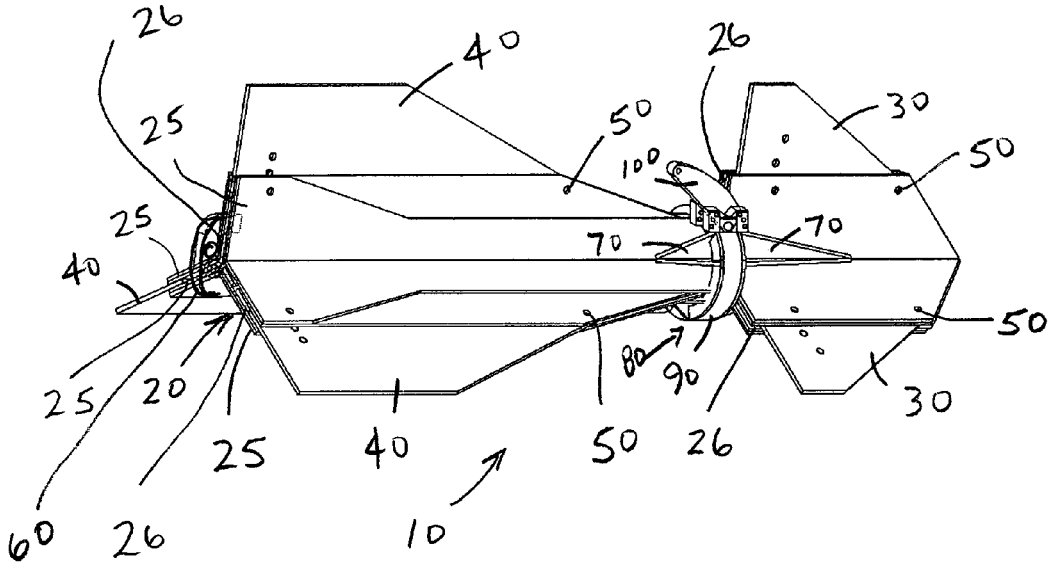
FIG. 2 is a perspective view of the anchor.
Figure 3:
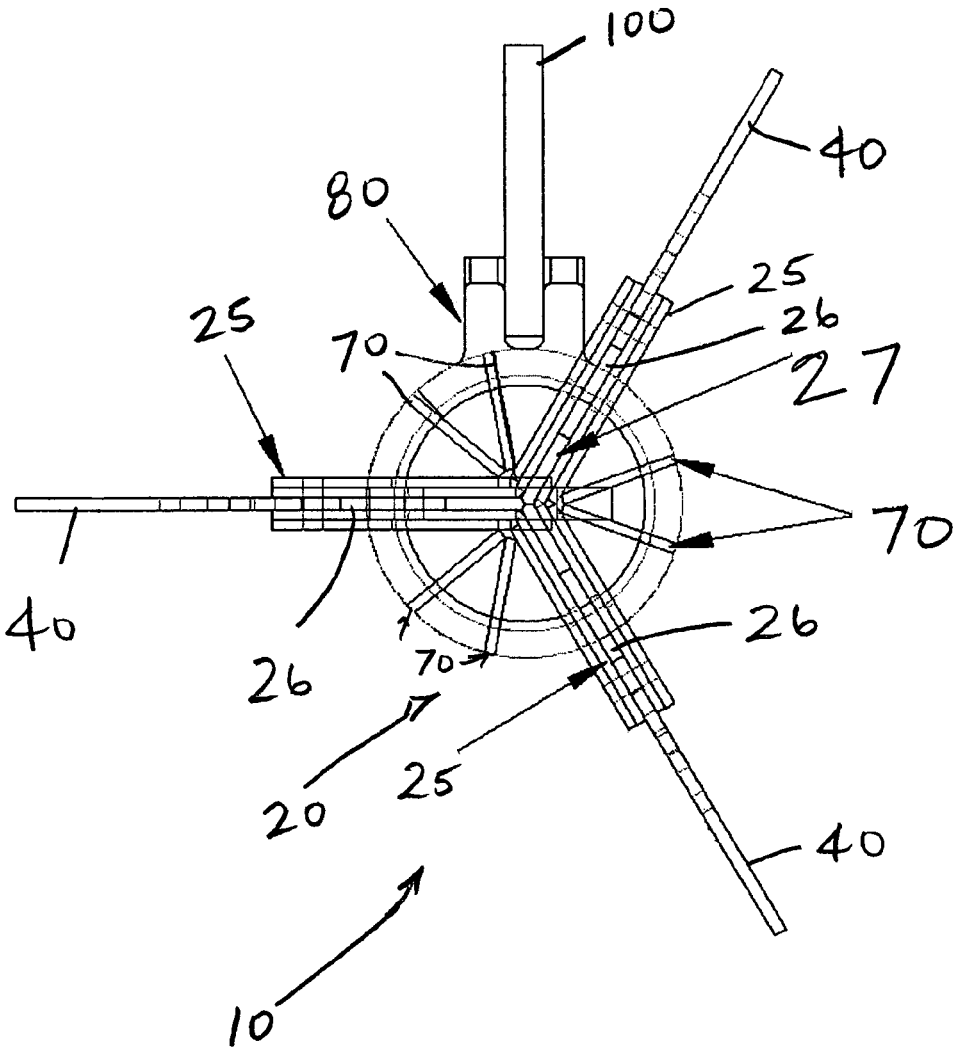
FIG. 3 is a view down the longitudinal axis of the anchor (i.e. an "end on" view).

FIGS. 1–3 show the key structural elements of the anchor. Anchor 10 comprises an elongated central body 20 having a longitudinal axis X and comprising a plurality of radially outwardly extending channel members 25, as especially seen in FIGS. 2 and 3. While the particular embodiment shown comprises three channel members, each spaced 120 degrees apart from one another around the entire circumference, it is understood that two, four, or more channel members could be used. In comparison to the generally circular in cross section main shafts of certain prior art anchors, in certain applications the multiple channel member central body is a more capacity efficient anchor shaft since it tends to channel the soil into the "V" of the channel member, compressing it, rather than spreading the soil like a cylindrical shaft. This gives the anchor improved ability to dive and generate holding capacity. In settings involving shallow penetration of the current anchor, the channel member central body also improves the anchor's ability to plow through the upper layer of soil, creating a mound, which in turn builds enough resistance to turn the anchor and allow it to dive, as described in more detail hereafter.

Within the channel members are disposed a plurality of nose plates 30 and tail plates 40. It is understood that references to "nose" and "tail" are used for convenience only, the nose plates being those that are in the lower or bottom position and the tail plates being those in the upper or top position, when the anchor is in its usual orientation for penetration into a waterbottom, as in FIG. 1.

In the preferred embodiment, nose plates 30 and tail plates 40 are preferably hingedly connected within channels 26 in channel members 25, for example by pins 50, usually near the lower end of the plates. Nose plates 30 and tail plates 40 are therefore free to rotate within at least a limited arc, and move inwardly and outwardly as illustrated by the phantom lines in FIG. 1. When the plates are in a desired position, they may be locked in place by a means for fixing the plates in that position, for example by pins 56 fitted through matching holes in the plates and in the channel members. By the reference to "pins" in this application, it is understood that the term encompasses elongated members such as bolts, screws, etc., or other like means which can be readily inserted through holes in the other elements. A plurality of openings, such as slots or holes 55 may be placed in the plates, as can be seen in the figures, to permit a range of positions for the plates to be locked into. Alternatively, nose and tail plates can be pin-connected within the channels, but with multiple (e.g. upper and lower) pins, so that the plates can be moved radially inward or outward (that is, not rotating around a hinge pin, but simply moving straight in and out). It is understood that different profile shapes for the nose and tail plates are possible, as desired for specific applications. The adjustable plate areas allow some standardization of the anchor of the present invention, with only the plate areas to be varied and the anchor thereby used for a variety of applications in a variety of soil strengths. By adjusting the ratio of nose plate and tail plate areas, the present anchor can be set to have a center of soil resistance such that the anchor will rotate as desired under load and be ready to dive at the appropriate pre-determined angle.

It is understood that the present invention, in other possible embodiments, comprises anchors with generally cylindrical-in-cross-section central bodies, with radially movable plates as described above. The invention further encompasses anchors, of any central body configuration, having a plurality of movable plates proximal one end only (e.g., either nose or tail plates only), or plates which span most or all of the total length of the anchor, whether or not said anchors comprise the movable mooring line attachment arm disclosed in some of the presently preferred embodiments.

In the presently preferred embodiment, an attachment point, for example an eye 60, may be attached to the end of anchor 10, for attachment of a recovery line and ease in recovery of the anchor.

FIG. 3 shows additional detail regarding central body 20 and nose and tail plates 30 and 40. As can be seen, the preferred embodiment shown comprises three channel members 25 spaced equally around the circumference of the central body. It is understood that different materials and fabrication methods can be used for the central body. In one presently preferred embodiment, central body 20 is formed from plate metal bent into the desired shape; for example, for the embodiment shown in FIG. 3, three plates can be bent into the shallow "V" shapes, with 120 degrees in the V shape, and then fastened together via welding or other means known in the art to form the cross section. The plates, for example tail plates 40, are fixed in the channels thereby formed. It is understood that other means of fabrication could be used, for example milling the central body out of solid stock, forging, casting, etc. with the desired shape, etc. Other materials may be suitable, for example plastics, fiber reinforced composites, etc. By similar means, anchor 10 can be made with two, four, or more channel members. Gussets 70 support load ring assembly 80, described further below. For structural strength, central body 20 may comprise internal spacing plates 26, which assist in spreading the applied load through the structure of the anchor. The edges of nose and tail plates 30 and 40 can be cut with sharp angular shapes or with an edge having an elliptical or circular shape.

Figure 1A:
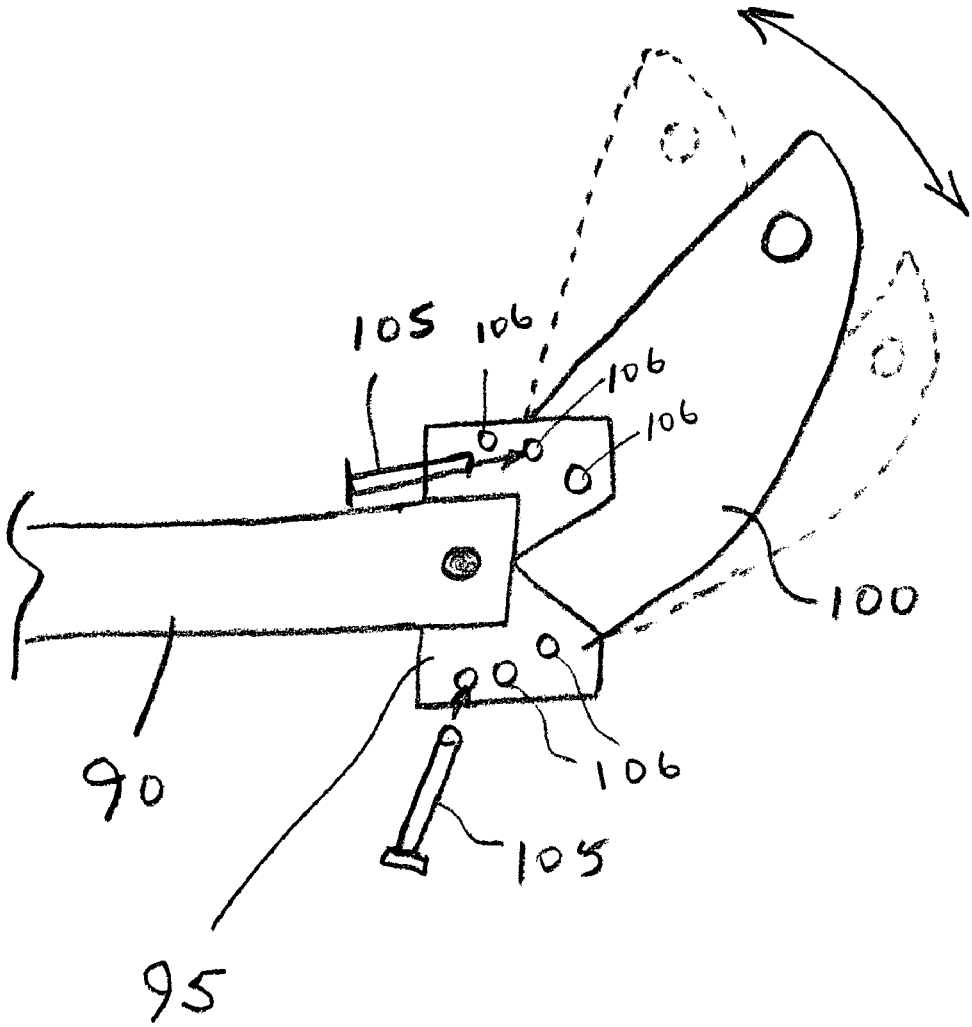
FIG. 1A shows additional detail of the load ring and arm.

Anchor 10 comprises a means for attaching a mooring line thereto. In a presently preferred embodiment, the means for attaching a mooring line comprises a load ring assembly 80, comprising a rotating load ring 90 encircling central body 20, and free to rotate completely around the circumference of anchor 10. Load ring 90 preferably comprises a bracket 95 and an arm 100 connected thereto, and preferably hingedly connected thereto so as to be movable within a range of angles with respect to the longitudinal axis X of anchor 10. This range of movement is partially shown in FIG. 1 by the phantom lines. A means for fixing arm 100 at a desired angular position (or within an angular range) is provided, for example a pin or pins (or bolts, screws, or other suitable members, as described in more detail herein) 105 inserted through holes 106 in bracket 95, and, if desired, arm 100. FIG. 1A shows more detail of arm 100. Arm 100 can be locked at a desired angular position, or constrained to move only within a desired range of angular positions. Load ring 90 may rotate around a bearing surface or axial channel supported by gussets 70, as seen in the drawings. Preferably, there are several radial gussets 70 to support the load ring. Arm 100 has a fixed length and is preferably hingedly attached to bracket 95, with at least one, and preferably two sets of retaining pins (or bolts, screws, etc., as earlier described herein) constraining its rotation, as shown in FIG. 1A. The upper retaining pin restricts the arm's movement upward or closer to the longitudinal axis of the central body, and the lower retaining pin restricts the arm's movement downward.

Other embodiments of the present anchor are encompassed within the present invention, with regard to variations on the means for attaching a mooring line. Some of the other possible embodiments include anchors, with or without the radially movable plate elements described herein, wherein:

1) the arm of the present invention is fixed so as to not rotate about the circumference of the anchor, but which is still hingedly affixed so as to permit easy change of the angle of the arm with respect to the longitudinal axis of the anchor, for example by being hinged to a fixed bracket on the anchor; or
2) the arm is fixed (e.g. by welding or other like means) at a desired angle with respect to the longitudinal axis of the anchor, whether or not movable around the circumference of the anchor.

Fabrication of the Anchor

The anchor of the present invention in a presently preferred embodiment can be cost effectively fabricated from flat steel plate or other strong materials. Central body 20 can be comprised of a series of bent plates, bent to an angle equal to the number of radial plates divided into 360 degrees (e.g., for three plates, the appropriate angle is 120 degrees). Such plates can be sandwiched in sufficient number to provide the required strength. Nose plates and tail plates 30 and 40 can also be made of the same material, or of alternate materials, including composites such as fiberglass, or other plastics. The plates are inserted into channels 26 and either fixed or pinned at the lower and upper end exposing a pre-determined amount of plate area extending outside the channels.

Installation and Use of the Anchor

Figure 4:
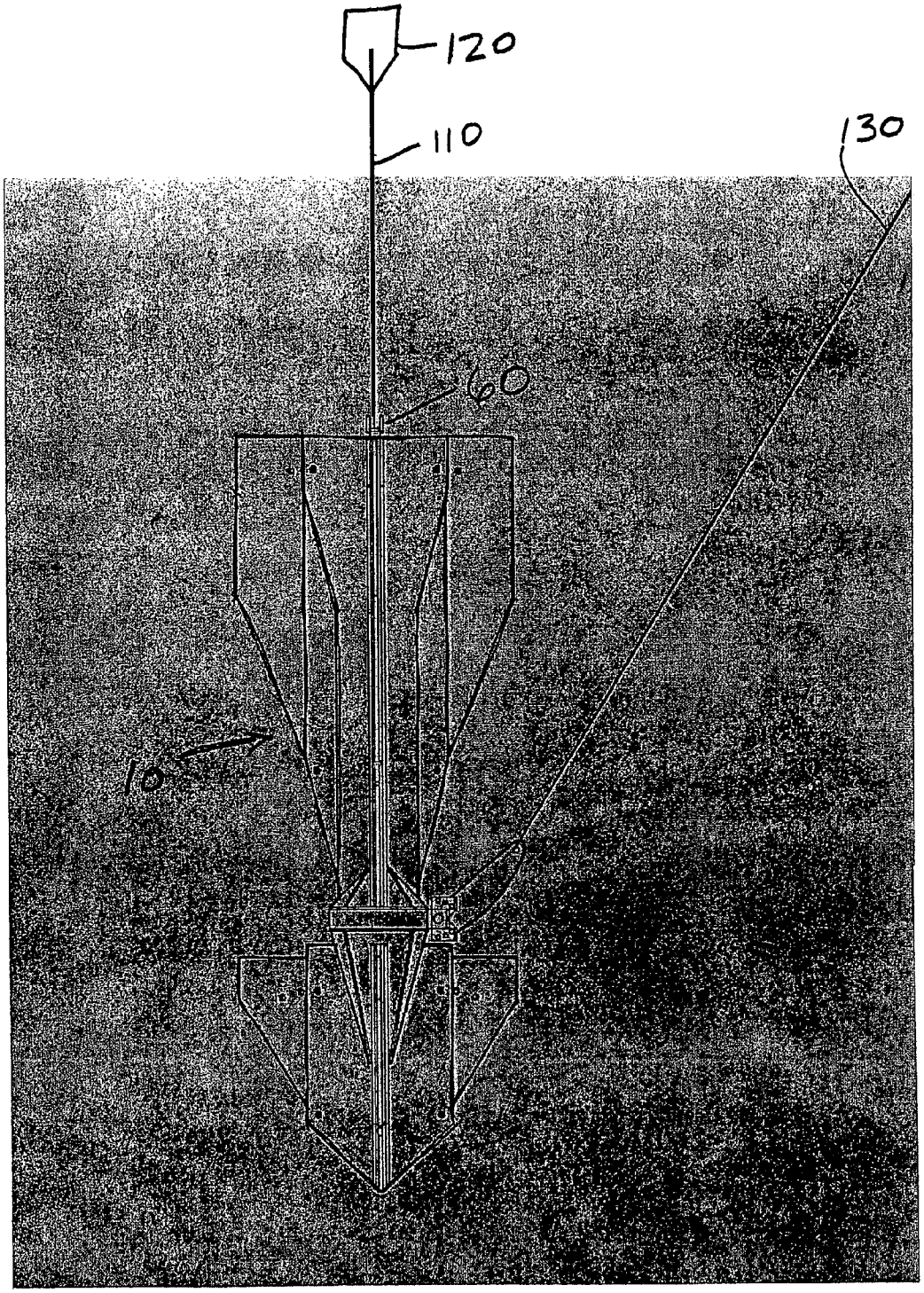
FIG. 4 shows the anchor buried in the soils of a waterbottom, prior to a load being placed on the mooring line.

Anchor 10 may be installed in a waterbottom by various procedures known in the art for gravity-installed anchors. In substance, said procedures typically comprise lowering the anchor to a desired height above a waterbottom, then dropping the anchor and permitting it to fall to and into the soils comprising the waterbottom. The drop height and penetration distance will of course vary with particular applications, but an exemplary setting is dropping the anchor from about 200 feet above the waterbottom, with penetration into the soils of about 50 feet (depth of the nose of the anchor beneath the waterbottom). FIG. 4 shows anchor 10 in place in the soils after dropping. A recovery line 110 is preferably connected to the trailing end of anchor 10 by an eye 60. Recovery line 110 may comprise a buoy 120 to aid in recovery. Mooring line 130 connects anchor 10 to the structure being moored.

The angle at which arm 100 is set with respect to longitudinal axis X of central body 20 allows the user to pre-determine the dive angle desired based on the uplift angle of the mooring line load applied. The present anchor has a natural soil resistance center point, and the diving moment is created by applying the mooring line load above this center point. The arm induces a moment into the anchor which under a given mooring line uplift angle, will keep the nose of the anchor pointed down. With the nose angled down, with increasing load the anchor dives deeper into the soils of the waterbottom. As described above, and as seen in detail in FIG. 1A, in a preferred embodiment, there are two retaining pin assemblies for arm 100, one restraining upper motion (that is, the minimum angle between the arm and the longitudinal axis of the anchor) and one restraining lower motion (the maximum angle between the arm and the longitudinal axis of the anchor). These settings will be based on the anticipated uplift angles of the attached mooring line. The arm can be fixed in a single angle for applications where drag distance is less critical since the anchor will continue to rotate until the load creates a diving moment and the anchor begins to dig. The arm may also be restrained on the lower end alone since the forward (lower) movement of the arm controls the dive angle of the anchor for applied uplift angles from about 0 to 45 degrees. An additional benefit of arm 100 is that during installation of anchor 10, the mooring line attachment is held away from central body 20 and thereby reduces the occurrences of the mooring line getting hung up on tail plates 40 when arm 100 is out of phase with (that is, not radially aligned with) the load direction.

Figure 5:
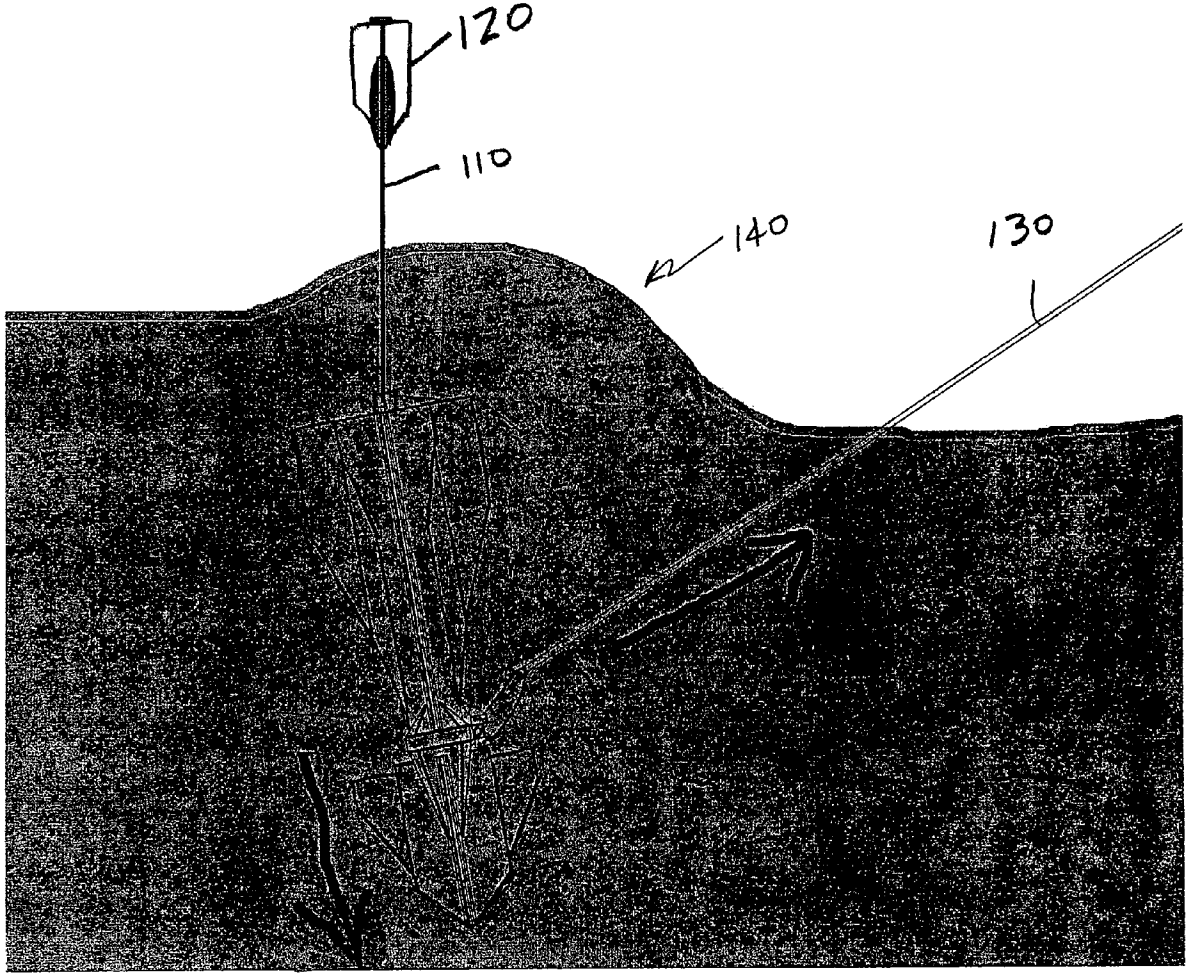
FIG. 5 shows the initial response of the anchor to a load placed on the mooring line.

FIG. 5 shows anchor 10 as it begins to move under the influence of a load applied to mooring line 130. Anchor 10 begins to turn from its original substantially vertical position, and to typically push up a mound of soil 140 as the anchor moves through the soil.

Use and Performance of the Anchor

Figure 6:
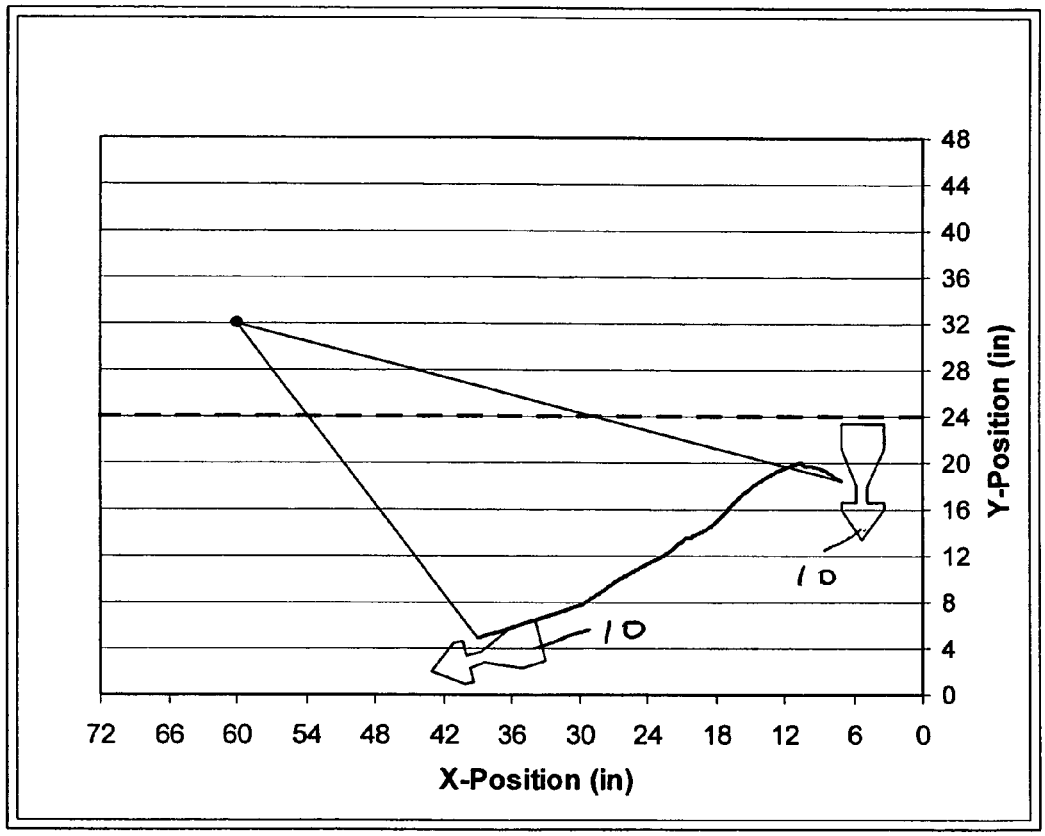
FIG. 6 is a diagram showing a representative trajectory of the anchor, moving through the soils of a waterbottom, in response to a load placed on the mooring line.

Exemplary behavior and performance of one embodiment of the anchor of the present invention can now be described. The first action seen when mooring line 130 has a load applied is that the load ring 90 and arm 100 swing in the soil and align themselves, radially, with the applied load. This is typically achieved without any anchor movement since the load ring and arm have significantly less area than the nose and tail plates or central body. Thus there is far less soil-induced resistance on the arm than the main body and plates of the anchor. As the mooring line load increases, the ratio of the soil resistance between the upper plates and the lower plates is tested about the arm. The lower section of the anchor will rotate out from the vertical position it has assumed after installation, until the moment placed on the anchor through the arm is balanced about the arm attachment. FIG. 6 is an exemplary diagram of the trajectory of anchor 10 as it moves through soil in response to a load, diving into deeper and typically stronger soils, eventually assuming an orientation in which the highest degree of holding capacity is achieved. It is to be understood that FIG. 6 is offered by way of example only, and that the particular scale shown is applicable only to this example. Then, as increased load is applied, the anchor begins to translate deeper into the soil at a designed dive angle. The second or lower position in FIG. 6 illustrates this stage. The anchor's dive angle from this stage forward will be based on the mooring line uplift angle and the rotational settings on the arm (that is, at what angle the arm is fixed with respect to the axis of the overall anchor). This is the case illustrated in FIG. 6, the anchor traverses a curved path as it dives, due to a substantial change in the uplift angle applied.

Those having ordinary skill in the relevant art will recognize the calculations suitable to determine drag forces on the nose and tail plates of anchor 10, and the resultant moment about the attachment point, and further the effect of a change in angle between the arm and the longitudinal axis of the central body.

Other Embodiments

While the preceding description sets out specifics regarding certain embodiments of the invention, it is understood that other embodiments are possible without departing from the scope of the invention. For example, the invention encompasses anchors comprising laterally movable fins or plates, whether or not same are rotatably movable on a central body, or movable simply in and out, and whether or not said anchors comprise the movable mooring line attachment arm. The invention further comprises anchors which have only one set of plates (e.g., from the presently preferred embodiments shown, only nose plates, only tail plates, or plates which may span most or all of the length of the anchor). The invention further comprises anchors having attachment arms which may be set at a desired angle with respect to a longitudinal axis through the anchor body, whether or not movable or adjustable to different angles or movable around the circumference of the anchor. Various materials are possible for the different parts of the invention (sheet metal, composites, fiberglass, plastics, etc.); dimensions of the anchor can be altered to suit specific applications; the anchor can have different numbers of radially outwardly extending channel members (two, three or more); areas and shape of the nose and tail plates can be altered; the number of mooring line attachments can be one or more; and other changes are possible.

Therefore, the scope of the invention is not limited to the specific embodiments set out herein, but only by the appended claims and their legal equivalents.

I claim:

1. An anchor, comprising:

a) an elongated central body comprising a longitudinal axis and a plurality of radially outwardly extending channel members, each comprising a channel therein;

b) a plurality of radially outwardly extending plates comprising longitudinally spaced apart nose plates and tail plates disposed within said channels of said channel members and attached to said central body so as to be movable radially inwardly and outwardly, and a means for fixing said plates in a desired position; and c) a means for attaching a mooring line to said anchor.

2. The anchor of claim 1, wherein said means for attaching a mooring line to said anchor comprises an arm extending radially outwardly from said central body, and movable to a desired angular position with respect to said longitudinal axis of said central body, and a means for fixing said arm at said desired angular position.

3. The anchor of claim 2, wherein said means for attaching a mooring line to said anchor comprises a load ring assembly comprising a load ring rotatable about a circumference of said anchor and a bracket attached thereto, and wherein said arm is hingedly fixed to said bracket, and said means for fixing said arm at said desired angular position comprises at least one pin insertable through said bracket.

4. The anchor of claim 3, wherein said pin is inserted through said bracket so as to permit said arm to move through a desired range of angles with respect to said longitudinal axis of said central body.

5. An anchor, comprising:

a) an elongated central body comprising a longitudinal axis and a plurality of radially outwardly extending channel members, each comprising a channel therein;

b) a plurality of radially outwardly extending plates disposed within said channels of said channel members and attached to said central body so as to be movable radially inwardly and outwardly, and a means for fixing said plates in a desired position comprising one or more pins inserted through matching holes in said plates and said channel members; and c) a means for attaching a mooring line to said anchor.

6. An anchor, comprising:

a) an elongated central body comprising a longitudinal axis and a plurality of radially outwardly extending channel members, each comprising a channel therein;

b) a plurality of radially outwardly extending plates disposed within said channels of said channel members and attached to said central body so as to be movable radially inwardly and outwardly, wherein said plates are hingedly fixed within said channels and rotatable inwardly and outwardly from said central body, and a means for fixing said plates when rotated to a desired position; and c) a means for attaching a mooring line to said anchor.

7. An anchor, comprising:

a) an elongated central body comprising a longitudinal axis;

b) a plurality of radially outwardly extending plates attached to said central body so that a broad face of each of said plurality of plates lies in a plane substantially parallel to said longitudinal axis of said central body; and c) a means for attaching a mooring line to said anchor, comprising an arm extending radially outwardly from said central body a desired angular position with respect to said longitudinal axis of said central body.

8. An anchor, comprising:

a) an elongated central body comprising a longitudinal axis;

b) a plurality of radially outwardly extending plates attached to said central body; and c) a means for attaching a mooring line to said anchor, comprising an arm extending radially outwardly from said central body at a desired angular position with respect to said longitudinal axis of said central body, wherein said arm is movable within a range of angles with respect to said longitudinal axis, and further comprising a means for fixing said arm at a desired angular position.

9. The anchor of claim 8, wherein said means for attaching a mooring line to said anchor comprises a load ring assembly comprising a load ring rotatable about a circumference of said anchor and a bracket attached thereto, and wherein said arm is hingedly fixed to said bracket, and said means for fixing said arm at a desired angular position comprises at least one pin insertable through said bracket.

10. The anchor of claim 9, wherein said plates are movable radially inward and outward from said central body, and further comprising a means for fixing said plates in a desired position.

11. The anchor of claim 10, wherein said means for fixing said plates in a desired position comprises one or more pins inserted through said plates and said central body.

12. The anchor of claim 11, wherein said elongated central body comprises a plurality of radially outwardly extending channel members, each comprising a channel therein, and said plurality of plates are disposed within said channels of said channel members.

13. An anchor for mooring of structures to waterbottoms, comprising:

a) an elongated central body comprising a longitudinal axis and a plurality of radially outwardly extending channel members, each comprising a channel therein;

b) a plurality of nose plates and tail plates disposed within said channels of said channel members, said nose plates and said tail plates spaced apart along said longitudinal axis, and attached thereto so as to be movable radially inwardly and outwardly, and a means for fixing said nose plates and tail plates in a desired position; and c) a means for attaching a mooring line to said anchor, said means comprising a load ring assembly comprising a load ring with a bracket thereon and an arm rotatably connected to said bracket and extending radially outwardly from said central body, said load ring movable around the circumference of said anchor, said arm movable to a desired angular range with respect to said longitudinal axis of said central body, and a means for restraining said arm within said desired angular range.

14. The anchor of claim 13, wherein said means for restraining said arm within said desired angular range comprises one or more pins inserted through said bracket.

15. The anchor of claim 14, wherein said central body is formed from a desired number of plates of steel, bent so as to form elongated V-shape channels, and joined together thereafter, and further comprising one or more gussets supporting said load ring assembly.

16. The anchor of claim 15, wherein said desired number of plates is three.

17. The anchor of claim 16, wherein said anchor comprises more than one means for attaching a mooring line to said anchor.

* * * * *